US005582040A

United States Patent [19]

Khan

[11] Patent Number: 5,582,040

[45] Date of Patent: Dec. 10, 1996

[54] WATER BALANCING APPARATUS FOR HORIZONTAL AXIS AND VERTICAL AXIS LAUNDRY APPLIANCES

[76] Inventor: Aman U. Khan, 1413 N. Manor Dr., St. Joseph, Mich. 49085

[21] Appl. No.: 513,072

[22] Filed: Aug. 9, 1995

[51] Int. Cl.[6] ..... D06F 37/22; D06F 37/24

[52] U.S. Cl. ..... 68/23.2; 68/23.3; 74/573 F; 210/144

[58] Field of Search ..... 68/12.06, 23.2, 68/23.3; 210/144; 74/573 F

[56] References Cited

U.S. PATENT DOCUMENTS

| | | | |
|---|---|---|---|
| 1,604,748 | 10/1926 | Grauer | 210/144 |
| 2,224,241 | 12/1940 | Verdier et al. | 74/573 F X |
| 2,463,801 | 3/1949 | Page | 68/23.2 |
| 2,539,533 | 1/1951 | Douglas | 68/23.2 X |
| 2,886,979 | 5/1959 | Baxter | 74/573 F |
| 3,119,773 | 1/1964 | Compans | 210/144 |
| 3,135,688 | 6/1964 | Compans | 210/144 |
| 3,190,447 | 6/1965 | Scott | 210/144 |
| 3,235,082 | 2/1966 | Compans | 210/144 X |
| 3,275,146 | 9/1966 | Severance | 210/144 |
| 3,306,453 | 2/1967 | Khan | 210/144 |
| 3,983,035 | 9/1976 | Arkeveld | 68/23.2 X |
| 4,991,247 | 2/1991 | Castwall | 68/23.2 X |
| 5,345,792 | 9/1994 | Farrington | 68/23.2 |

*Primary Examiner*—Philip R. Coe
*Attorney, Agent, or Firm*—Baker & Daniels

[57] ABSTRACT

A balancing apparatus for counterbalancing an unbalanced load in a rotating or spinning drum such as a clothes basket in a washing machine. The balancing apparatus includes a drive plate fixed to the drive shaft of the spinning drum. Balancing tanks disposed at spaced intervals around the drum are connected to a fluid supply, such, as a self contained fluid tank, through passages controlled by valves mounted to the drum or supply tank. When the rotating drum tilts relative to the drive shaft as a result of unsymmetrical centrifugal forces produced by the unbalanced load, the valve or valves controlling flow into the balance tanks opposite the unbalanced load are moved into engagement with valve selector slides mounted on the drive plate to open the passages and allow water from the fluid tank into the balance tanks to balance the drum. The valves and valve selector slides are preferably complementarily designed to permit fluid flow into the balance tanks opposite the unbalanced load at drum rotating speeds below and above the critical speed of the rotating drum.

21 Claims, 4 Drawing Sheets

WATER BALANCING APPARATUS FOR HORIZONTAL AXIS AND VERTICAL AXIS LAUNDRY APPLIANCES

BACKGROUND OF THE INVENTION

The present invention pertains to an apparatus for counterbalancing unsymmetrically distributed centrifugal forces in a rotating body, and, in particular, to a balancing apparatus for counterbalancing an unbalanced batch of laundry being rotated at high speeds within a laundry machine for purposes of water extraction.

In contemporary laundry appliances, such as automatic washing machines and dryers, wherein clothes are washed and centrifuged in the washer and then transferred to the dryer for clothes drying, or in combination washer-dryers wherein clothes are washed, rinsed, spun dry and tumbled dry with the application of heat energy, the drying time required to dry the clothes is dependent on several factors, including the applied heat and the amount of moisture retained in the clothes at the commencement of the drying cycle. When washers are used without a complementary dryer and the washed clothes are line dried, the amount of moisture similarly impacts drying time. Thus, in order to reduce the drying time, the excess moisture of the clothes is desirably reduced before the drying cycle.

One technique frequently employed to extract water from the clothes is to provide a high rotating drum speed during the extraction part of the wash cycle to remove large amounts of water from the load prior to its tumble or line drying. One problem with such a spinning technique is that when a load or batch of clothes is introduced into the clothes basket or cylinder, the load is frequently distributed in such a manner that the center of mass of the loaded cylinder will not coincide with the cylinder axis, thereby producing an unbalanced centrifugal force which is directly proportional to the mass of the unbalanced portion of the total rotating mass, the square of the angular velocity of such unbalanced mass and the radius of the unbalanced mass from the axis of rotation of the cylinder.

Besides affecting the power input required to rotate the cylinder, an unbalanced condition may cause serious vibrations during cylinder rotation. The vibrations may be sufficiently great to actually cause the laundry machine to lift from its support and produce a violent movement of the machine which is colloquially referred to as "walking".

To overcome these vibrational problems, previous laundry machines have employed a variety of tactics. For instance, some laundry machines operate at a sufficiently limited spin speed such that the unbalanced loads typically encountered during operation are insufficient to produce a sufficient amount of centrifugal force to lift the machine form its support and produce "walking" of the machine. Other machines reduce spin speeds upon sensing a severe vibration occurrence. While useful to some extent, these devices have the disadvantage of slowing the overall drying process as the rate at which water is extracted during the period of time in which they are operating is less than desired. Extra moisture retained in the clothes is therefore required to be removed either by a longer period of line drying or by additional consumption of heat energy in machine drying as a longer drying period is necessitated.

Other balancing mechanisms have suspended the entire laundry mechanism on a pivot along with an additional mass producing, dead weight within the enclosing cabinet on a complex spring system. The suspended system is permitted to vibrate within the cabinet in which it is enclosed, and the dead weight tends to reduce undesirable effects of the unbalanced centrifugal forces. A shortcoming of these designs is that, to accommodate the vibratory motion, the size of the clothes basket must be smaller for a given size cabinet, thereby reducing washer capacity.

Another technique for overcoming vibration tendencies of an eccentric loading within a rotating clothes basket is to selectively fill tanks provided around the periphery of the clothes basket with fluid to counterbalance the eccentric mass during certain portions of the rotation of the clothes basket. An assortment of devices intended to realize this technique are known, and representative devices are disclosed in U.S. Pat. Nos. 2,886,979, 3,119,773, 3,135,688, 3,190,447, 3,306,453 and 3,983,035. While perhaps having some utility to overcome vibrational problems, these devices are not without their shortcomings.

For example, while many prior art washers with balancing pockets perform balancing of the unbalanced load after a critical speed of the washer has been reached, for rotational speeds above a one gravity (one G) producing speed and below the critical speed, no balancing is performed. However, significant vibrations, especially with heavy loads such as blankets or pillows, are likely to occur at below critical speed. Consequently, the designers of these washers typically resorted to providing bulky dampening devices and an appreciable space between the wash tub and cabinet to allow for the vibrational movements or oscillations of the clothes basket and tub assembly caused by unsymmetrical centrifugal forces produced at below critical speed. These spaces undesirably increased the size of the washing machine or necessitated a smaller capacity clothes basket be used.

Another shortcoming of the prior art is that the components used to selectively introduce water into the appropriate balancing pockets are frequently complicated in design and assembly. As a result, installation and maintenance of the balancing apparatus may be time consuming and expensive.

Thus, it is desirable to provide a balancing system for a rotating apparatus which overcomes these and other shortcomings of the prior art.

SUMMARY OF THE INVENTION

The balancing apparatus of the present invention counterbalances unbalanced loads in rotating drums, such as clothes baskets in washing machines, to prevent the rotating unbalanced loads from generating undesirable levels of vibration. The balancing apparatus may also be configured to advantageously function both below and above the critical speed of the loaded rotating drum.

In one form thereof, the present invention provides a balancing apparatus for a centrifugal extractor machine including a rotatable drum mounted on a shaft, wherein the drum is tiltable relative to the shaft whereby the axis of rotation of the drum is angled relative to an axial direction in which the shaft extends. The balancing apparatus includes at least one valve actuator arranged around the shaft, a plurality of balancing pockets disposed around the drum for receiving fluid to counterbalance an unbalanced load in the rotatable drum tending to tilt the drum during drum rotation, a plurality of fluid passages for communicating fluid to the plurality of balancing pockets, at least one fluid supplier providing fluid to the plurality of fluid passages, and a plurality of valves controlling fluid flow through the plurality of fluid passages. The plurality of valves are each designed to operatively engage the valve actuator when the balancing pocket to which its respective valve passage communicates moves a certain distance toward the valve actuator during drum tilting, and engagement of each valve with the valve actuator opens the valve to allow fluid from the fluid supplier to flow through the fluid passage associated with the open valve and into the balancing pocket associated with the open valve to counterbalance the unbalanced load.

In another form thereof, the present invention provides, in combination, a laundry machine and a balancing apparatus. The laundry machine includes a rotatable drum and a motor powered drive shaft for rotatably driving the rotatable drum, wherein the drum is tiltable relative to the drive shaft whereby an axis of rotation of the drum is angled relative to an axial direction in which the drive shaft extends. The balancing apparatus, which counterbalances an unbalanced load in the rotatable drum, includes at least one valve actuator corotatable with the drive shaft, a plurality of balancing pockets disposed around the drum for receiving fluid to counterbalance the unbalanced load in the rotatable drum tending to tilt the drum during drum rotation, a plurality of fluid passages for communicating fluid to the plurality of balancing pockets, at least one fluid supplier providing fluid to the plurality of fluid passages, and a plurality of valves controlling fluid flow through the fluid passages. Each valve is structured and arranged to operatively engage the valve actuator when the balancing pocket to which its respective valve passage communicates moves a first distance toward the valve actuator during drum tilting. Engagement of each valve with the valve actuator opens the valve to allow fluid from the fluid supplier to flow through the fluid passage and into the balancing pocket associated with the open valve to counterbalance the unbalanced load.

In still another form thereof, the present invention provides a laundry apparatus including a rotatable drum, a motor powered drive shaft for rotatably driving the rotatable drum, resilient means for mounting the rotatable drum to the drive shaft to allow limited tilting of the rotatable drum relative to an axis of rotation of the drive shaft, valve actuator means corotatably mounted to the drive shaft, a plurality of balancing pockets disposed around the drum for receiving fluid to counterbalance an unbalanced load in the rotatable drum tending to tilt the drum during drum rotation, a plurality of fluid passages for communicating fluid to the plurality of balancing pockets, means for supplying fluid to the fluid passages, and valve means for operatively engaging the valve actuator means during drum tilting to selectively open the plurality of fluid passages to permit fluid flow from the fluid supplying means into the plurality of balancing pockets to counterbalance the unbalanced load in the rotatable drum.

One advantage of the present invention is that it counterbalances an unbalanced load in a rotating drum both above and below a critical speed of the rotating drum.

Another advantage of the present invention is that it may be employed with both vertical axis and horizontal axis laundry appliances.

Another advantage of the present invention is that the water supply for a balancing apparatus employing fluid receiving balance tanks may be positioned adjacent the balance tanks.

Another advantage of the present invention is that by positioning the valves and water supply to the balance tanks in close proximity to the tanks, a fast delivery of counterbalancing water is achieved.

Another advantage of the present invention is that it limits the need for the conventional suspensions, snubbers, pivots, and dead weights typically provided in laundry appliances to allow clothes baskets to pass through their critical speeds.

Still another advantage of the present invention is that by balancing the clothes basket below a critical speed the invention allows smaller clearances to be designed between the wash tub and the laundry machine cabinet.

Still another advantage of the present invention is that mounting the valves for direct activation allows for a proportional valve opening and permitting the valves to remain continuously open until the balancing is complete.

Still another advantage of the present invention is that freely available centrifugal force is utilized to feed water to the balance tanks.

Still another advantage of the present invention is that the fluid receiving tanks do not rely on oscillating components to deliver water but rather are provided with water by valves which are actuated by direct engagement with other balancing apparatus components.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
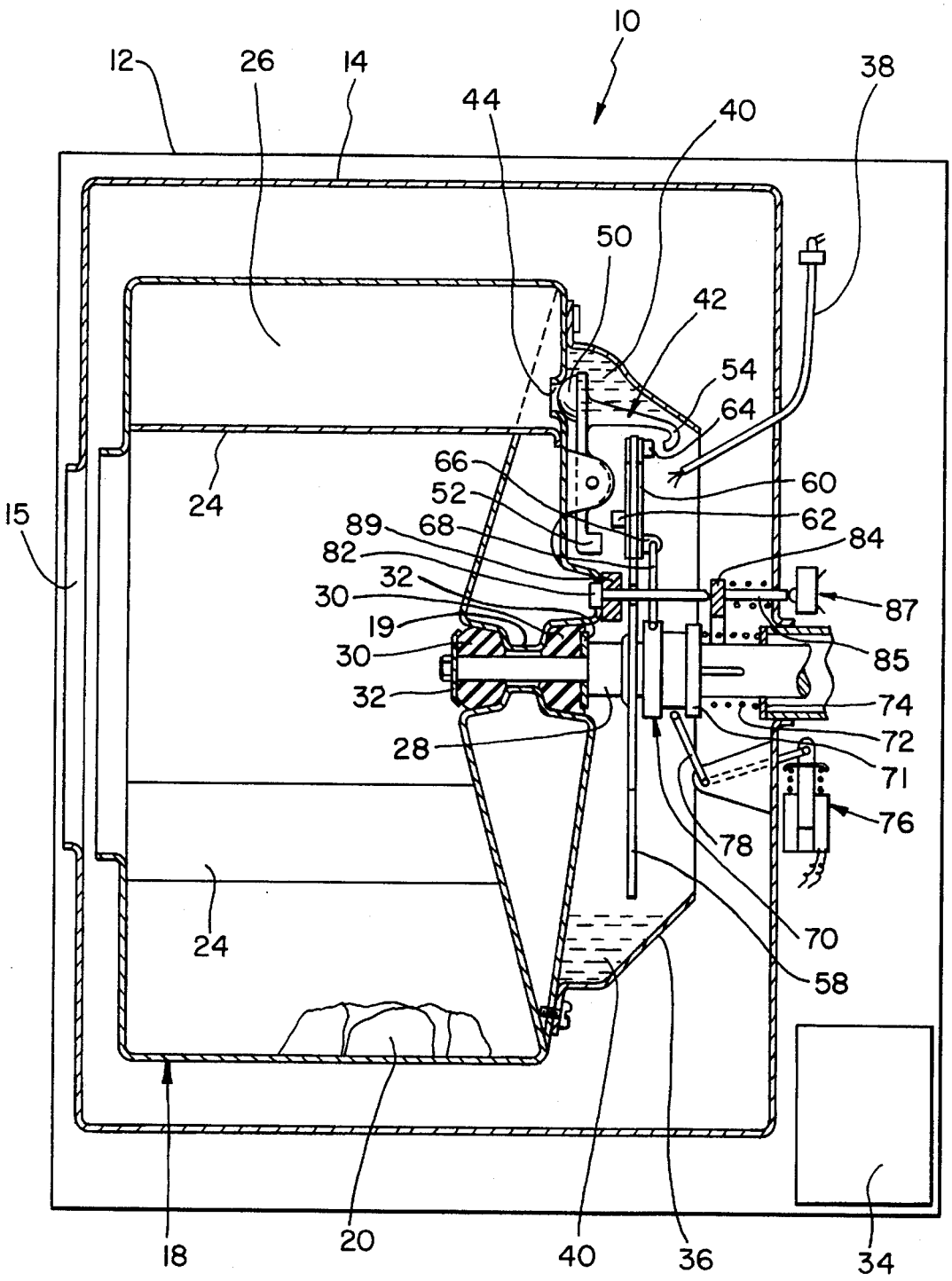
FIG. 1 is a side view in partial cross section and partially in diagrammatic form of an embodiment of the balancing apparatus of the present invention installed in a horizontal axis laundry appliance.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

Referring now to FIG. 1, there is shown a laundry appliance, namely a washing machine, with a balancing apparatus according to the principles of the present invention. In FIG. 1, a pertinent, fragmentary portion of the laundry appliance is shown in vertical cross-sectional side view. Certain structural portions of the remainder of the laundry appliance which may be of any suitable type known in the art have been abstractly shown or omitted in the interest of clarity of illustration, and further because the construction of such portions are not essential to an understanding of the present invention. Although shown and described herein with reference to a washer, it will be appreciated that this usage is merely illustrative of the present invention and not intended to be limiting. The balancing apparatus of the invention can be advantageously incorporated into a variety of devices, such as a combination washer/dryer, in which centrifugal force is used to extract liquid from materials within a rotating drum and in which vibrational forces resulting from an eccentric arrangement of the materials within the drum is desired to be reduced, or industrial extractors for other uses.

The washing machine is generally designated 10 and is a front-loading, horizontal clothes basket axis type machine. Washer 10 includes an external cabinet or housing abstractly shown at 12 in which is fixedly mounted stationery wash tub 14. Wash tub 14 includes a front opening 15 through which clothes or other materials to be washed may be inserted into and withdrawn from a clothes basket or washing drum, generally designated 18.

Clothes basket 18, which is rotatably mounted within wash tub 14, is cylindrically shaped and includes perforations (not shown) allowing liquid to flow under centrifugal force radially therefrom. Three axially elongated and radially inwardly projecting baffles 24 used to tumble clothes during a wash cycle are mounted 120° apart within basket 18 and each include an interior compartment 26 which serves as a liquid receiving pocket. When selectively filled with liquid as described further below, pockets or tanks 26 counterbalance an unbalanced load indicated at 20 to limit undesirable vibrations of the washer.

Clothes basket 18 is mounted to a reduced diameter portion of drive shaft 28. Annular rib 19 provided on the clothes basket hub is captured between a pair of resilient bushings 30 and a pair of washers 32 secured around drive shaft 28. The section of drive shaft 28 axially extending through wash tub 14 is connected with a not shown pulley system to a schematically shown motor 34 that powers the drive shaft rotation that effects rotation of clothes basket 18. A bearing mounting of drive shaft 28 and an appropriate seal around drive shaft 28 preventing moisture from escaping from wash tub 14 are not shown but are provided in a conventional fashion.

Secured for rotation on the rear wall of clothes basket 18 is a fluid distribution ring 36, preferably made from molded plastic. Ring 36 is a continuous, unsegmented ring into which fluid such as water may be introduced during balancing operations through a hose 38 in flow communication with a water source (not shown). When clothes basket 18 spins during extraction of material therein, fluid within ring 36 collects as shown at 40 under the influence of centrifugal force. Due to the unsegmented construction of ring 36, fluid anywhere around the full circular extent of ring 36 can pass into any of the liquid receiving pockets 26 if necessary to balance the system. In an alternate embodiment, hose 38 may be attached to a sump pump mounted within wash tub 14 to recirculate water collected therein.

In order to control the flow of fluid into pockets 26, valves, generally designated 42, are provided which open and close passages between pocket 26 and fluid 40 within fluid distribution ring 36. In the shown embodiment, these fluid passages comprise openings 44 formed into the rear wall of clothes basket 18. Although only one valve 42 is shown, three similar valves 42 spaced at 120° intervals to be aligned with baffle tanks 26 are preferably provided.

Figure 2:
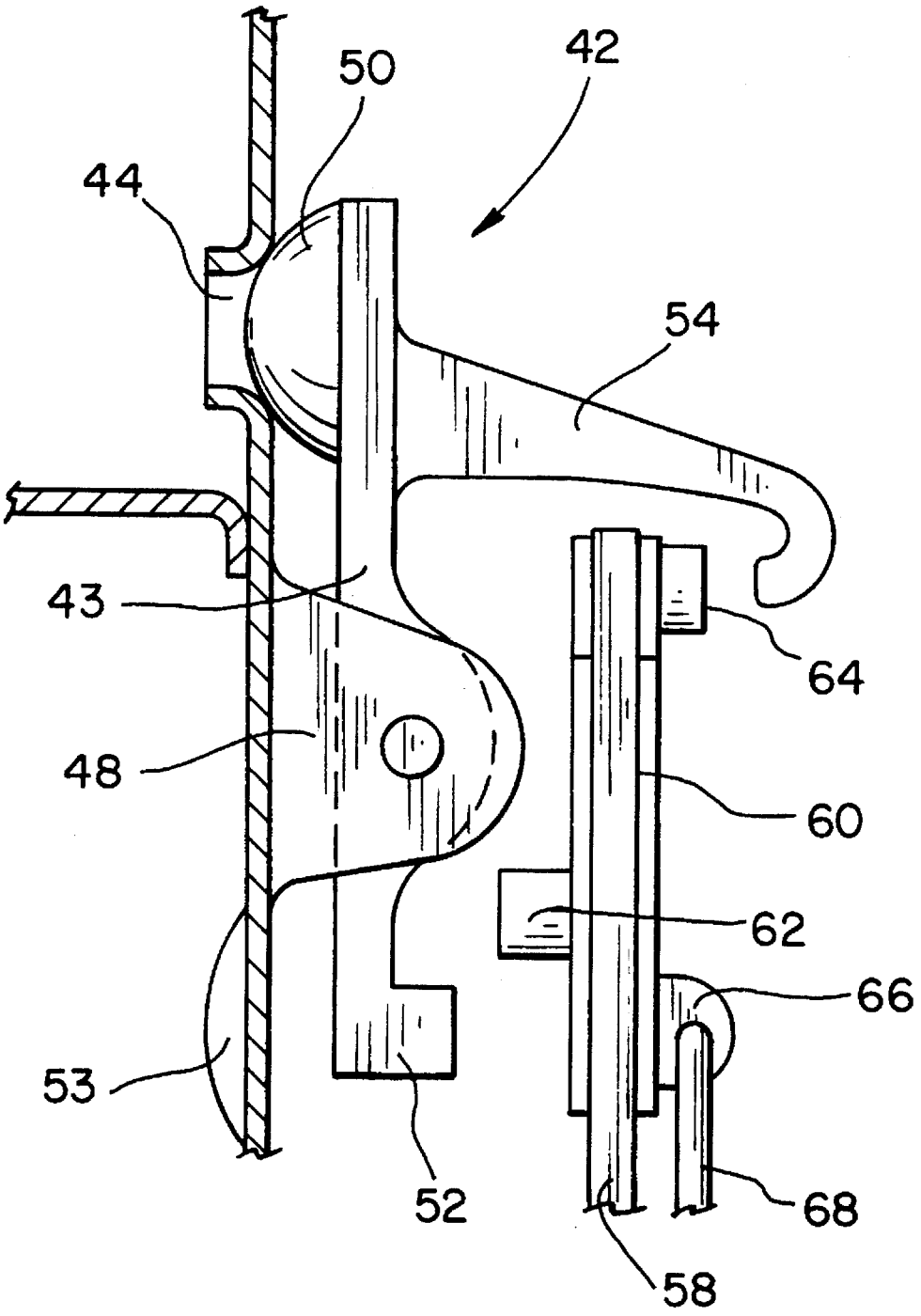
FIG. 2 is an enlarged view from FIG. 1 further illustrating the construction of a valve and valve selector of the balancing apparatus.

Referring now to FIG. 2, which is an enlarged portion of FIG. 1, valve 42 includes a body section 43 pivotally mounted to axially extending ears 48 fixedly attached to clothes basket 18. A valve seat 50, made of a resilient material such as neoprene, seals passage 44 when disposed in the Shown position. Valve 42 also includes a first actuating arm 52 and a second, hook shaped actuating arm 54. A recess 53 formed into the clothes basket rear wall may be provided to accommodate pivoting motion of actuating arm 52. While in the shown embodiment valve 42 is maintained in the shown position by the centrifugal forces acting thereupon, a spring (not shown) may also be provided to positively force valve 42 to the closed position.

In an alternate embodiment, valves 42 can be mounted to ears of a forward, annular flange which is integrally molded with plastic ring 36. Associated valve springs may be mounted between the valves and the forward flange. The forward flange, which would include the fluid passages 44 molded therein, would then be installed to the basket rear wall in a convenient fashion to facilitate assembly.

Referring again to FIG. 1, axially arranged on drive shaft 28 is an assembly which serves as a valve actuator for this embodiment. A rigid, disc shaped drive plate 58 made of steel or other suitable material is welded or otherwise rigidly secured to drive shaft 28 so as to rotate with shaft 28. Drive plate 58 provides a fixed reference from which deflection of basket 18 can be measured. Instead of a single drive disc, alternative components, for example a one-piece or multiple piece three-pronged spider having legs aligned with valves 42, could be substituted within the scope of the invention. Slidably mounted in radially oriented slots formed in the radial periphery of drive plate 58 are valve selector slides 60. While one slide is shown, three similar slides 60 spaced 120° apart and in registry with valves 42 for operative engagement therewith are arranged on drive plate 58. Slide 60 includes lugs 62, 64 on its forward and rearward faces respectively which are sized to abut and engage actuating arms 52, 54 of valve 42 as described further below.

An ear 66 on each slide 60 is connected by link 68 to collar 70 used to radially shift slides 60 between first and second positions. Annular collar 70 is keyed to drive shaft 28 and is axially slidable therealong. A biasing element such as helical spring 72 acting against washer 74 biases collar 70 forward to the shown position. A solenoid assembly 76 which is mounted externally of wash tub 14 to avoid being wetted operates an L-shaped linkage 78 designed to engage annular shoulder 71 of collar 70. When solenoid assembly 76 is energized, linkage 78 is pivoted to shift collar 70 inwardly, thereby pulling slides 60 to their not shown radially inward position, against the returning force of spring 72.

Fixedly mounted to clothes basket 18 at angular positions corresponding to baffles 24 are three similarly configured drive pins 82. As shown in FIG. 1, drive pin 82 axially projects through an opening in drive plate 58. This interconnection provides a positive drive mechanism between drive plate 58 and clothes basket 18 such that basket 18 will rotate with drive shaft 28 even if slippage were to otherwise occur between bushings 30 and annular rib 19. The distal ends of drive pins 82 contact a ring-shaped switch actuator 84 encircling shaft 28 which is spring biased forward into engagement with pins 82. Upon axial movement of drive pins 82, actuator 84 axially moves such that actuator finger 85 operates a switching assembly, abstractly shown at 87, connected to a not shown control mechanism to regulate the operation of washer 10. Switch assembly 87 includes a water supply switch and a motor speed hold or limit switch. Multiple fingers 85 are provided on actuator 84 to separately contact the various switches and to properly assemble a 360° switch actuator around the drive shaft.

A suitable not shown speed sensor monitors the rotational speed of drive shaft 28 or basket 18, for example by sensing the speed of motor 34. Any of a variety of speed sensors known in the art, for example a sensor which magnetically or electronically senses motor speed, may be employed. Pads 89 around drive pin 82 serve as drum deflection or tilting limits by abutting drive plate 58. As an electronic overload switch is preferably incorporated into switching assembly 87 and circuited with the washer control to stop basket spinning and to turn a red light on if basket tilting exceeds a design limit, pads 89 are furnished to provide operating range and noise reduction in achieving a mechanical fail safe device.

Figure 3:
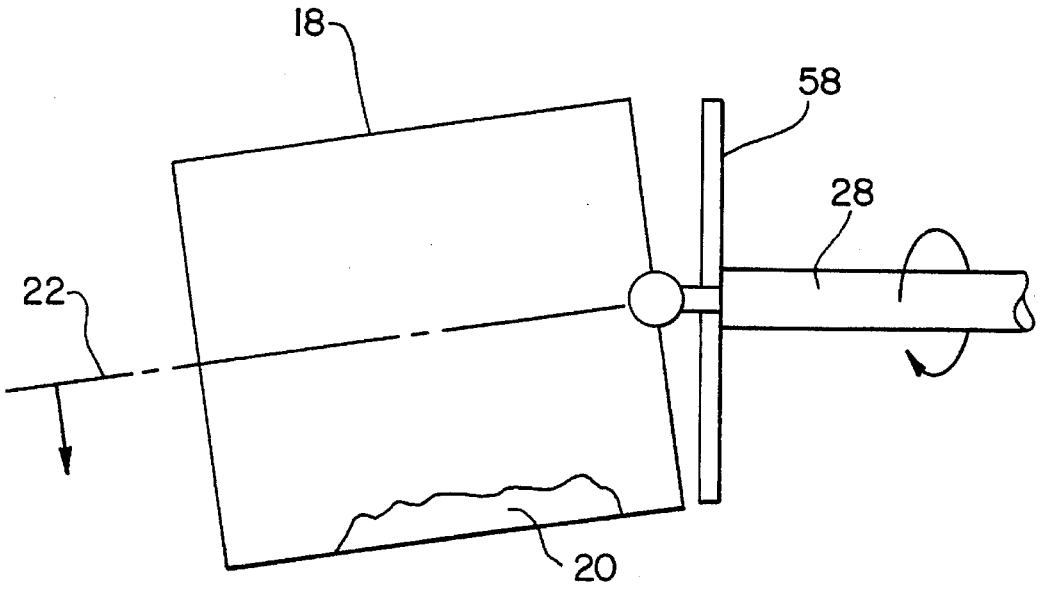
FIG. 3 is a diagrammatic view illustrating the direction in which the clothes basket tends to tilt relative to an unbalanced load when the clothes basket rotates below a washer critical speed.

The construction of the balancing apparatus utilized with washer 10 will be further understood in view of the following explanation of its operation. After the wash cycle is completed in washer 10 and after the pump out of the wash water from tub 14, a timer within the control mechanism switches to the spin mode or extraction cycle which involves rotating or spinning clothes basket 18 at high speeds in order to centrifugally force water within the load of clothes or other items through the perforations in basket 18 to partially dry the clothes. As rotation of basket 18 is accelerated from a non-rotating condition by operation of motor 34, rotational speeds are reached whereat a centrifugal force at the drum interior walls equal to one gravity or more is produced, which causes clothes to cling to the interior walls of clothes basket 18. One gravity speeds are typically more than 50 rpms depending on basket 18 diameter. As is known in the art, and as diagrammatically shown in FIG. 3, at speeds between one gravity and a critical washer speed, unsymmetrical centrifugal forces produced by the presence of eccentric or unbalanced loading tends to cause basket 18 to tilt toward the unbalanced load 20. In other words, the axis of rotation 22 of basket 18 is angularly shifted toward the unbalanced load 20 relative to the axis of rotation of drive shaft 28. The critical speed of rotating basket 18 is dependent on the basket diameter, mass of clothes basket 18 and the clothes load. In the shown embodiment, bushings 30 are particularly designed to permit such tilting in a controlled manner. The amount of tilting, is modified by controlling the durometer of the resilient bushings 30 and the spacing between the washers 32.

Figure 4:
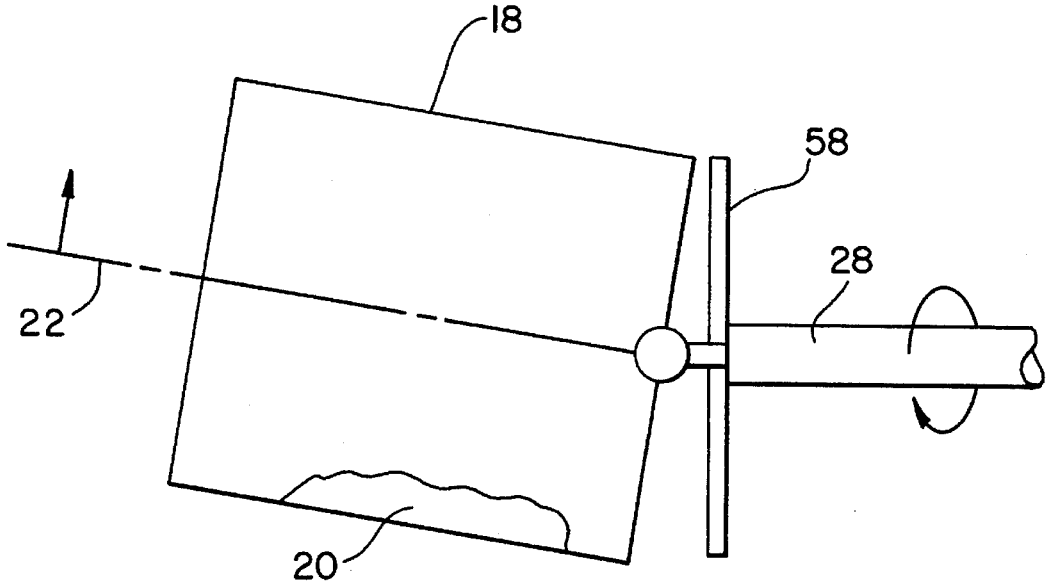
FIG. 4 is a diagrammatic view illustrating the direction in which the clothes basket tends to tilt relative to an unbalanced load when the clothes basket rotates above a washer critical speed.

As basket rotation continues to accelerate and reaches and passes the critical speed, the tilting of basket 18 shifts 180°. As shown in the diagrammatic view of FIG. 4, above the critical speed basket 18 tilts away from the unbalanced load 20. However, both below and above the critical speed, balancing of the unbalanced load 20 requires introduction into one, and possibly two, of the fluid pockets 26 most diametrically opposed to load 20.

Initially during the water extraction cycle, valve selector slides 60 are situated in the radially outward position shown in FIG. 1. At tumble speed and spinning speeds above the one gravity speed and below the critical speed, the unbalanced load 20 causes the bottom part of the basket 18 shown in FIG. 1 to float or tilt toward drive plate 58 and the upper part of the basket 18 in FIG. 1 to move away from drive plate 58. As basket 18 tilts, drive pins 82 axially move fingers 85 of ring switch actuator 84 to first actuate the water supply switch and then activate the motor speed limit switch in switching assembly 87. Specifically, activation of the water supply switch causes water to be introduced through hose 38 into distribution ring 36. And, if the basket 18 has tilted to the end of its operating range, the motor speed limit switch is activated and the acceleration of motor 34 is stopped such that motor 34 holds its speed to allow the balancing apparatus time to balance basket 18.

In particular, during tilting movement of the basket 18, the valve arm 54 illustrated in FIG. 1 directly engages lug 64 to lift valve seat 50 and open passage 44. It will be appreciated that because at this point in the extraction cycle lugs 62 on slides 60 are not aligned with valve arms 52, the valve 42 disposed most proximate to unbalanced load 20 will not be opened when that valve simultaneously moves toward the valve actuator during drum tilting. As a result, water will not be added to baffle tank 26 proximate load 20 to compound the tilting. When load 20 is located in line or near a baffle tank 26, two valves 412 may be brought into engagement with the valve actuator simultaneously to be opened thereby.

Water 40 introduced into ring 36 continuously pours through opened passage 44 to fill baffle tank 26 with enough water to even out the load, which in turn lessens drum tilting such that valve 42 disengages slide 60 and centrifugal force shifts valve seat 50 to close passage 44. If sufficient balancing has not been reached within a certain time limit after the motor acceleration has been halted and within a preselected preprogrammed maximum time allowed for the spin duration, a condition which may occur when, for example, the baffle tanks 26 are already filled, the washer control is preferably programmed to activate a spin recycling switch. The recycling switch causes the water supply to be turned off and the motor speed to be reduced such that the clothes are tumbled and baffle tanks 26 are emptied and to redistribute the load, and a second try is then made to reach the maximum spin speed. The water in tanks 26 is emptied automatically through ports (not shown) provided in the radially inner portion of tanks 26 when the basket rotating speed provides less than one gravity of centrifugal force. Water 40 falls from distribution ring 36 down into tub 14 during decelerating rotation of basket 18. If balancing occurs within the time limit, the basket 18 continues to be accelerated up to the critical speed. During this acceleration the weight distribution of unbalanced load 20 may shift, and therefore the balancing apparatus continues to counterbalance any further or different tiltings of basket 18 in the above described manner.

When the rotation of basket 18 reaches a predetermined critical speed as sensed by the speed sensor, the washer control energizes solenoid assembly 76 to move collar 70 and shift slides 60 into a second position for correct water distribution to the proper baffle tanks 26. The slide shifting to the second position need not occur precisely at the critical speed but rather may be performed within a speed range around the critical speed for the washer determined through tests to suit various clothes loads. At this position, slide lugs 62 are disposed for engagement with valve arms 52, and slide lugs 64 are not engagable with valve arms 54. When basket 18 then tips sufficiently in a direction opposite unbalanced load 20, drive pins 82 again serve to restart water introduction into distribution ring 36 through hose 38 and halt motor acceleration, and the valve arm 52 on the valve 42 opposite the load is brought into abutting contact with lug 62 to open the valve and allow water 40 through passage 44 into baffle tank 26 to balance the load in a similar manner as described above. Counterbalancing continues in this manner until the extraction cycle is complete, at which time the basket comes back to tumbling speed to fluff the clothes and empty the baffles before stopping.

The above embodiment can be modified in a variety of respects within the scope of the invention. For example, if counterbalancing is only to be performed above a critical speed, slide 60 can be eliminated and valve arms 52 could directly abut drive plate 58. Rather than the gate-like configuration shown, passages 44 Could be elongated tubes if spacing between baffle pockets 26 and distribution ring 36 is required. In addition, although not preferred as construction would be more complicated, separate hoses connected to a fluid source could be separately routed to the several valves 42 to individually introduce water to passages 44.

Figure 5:
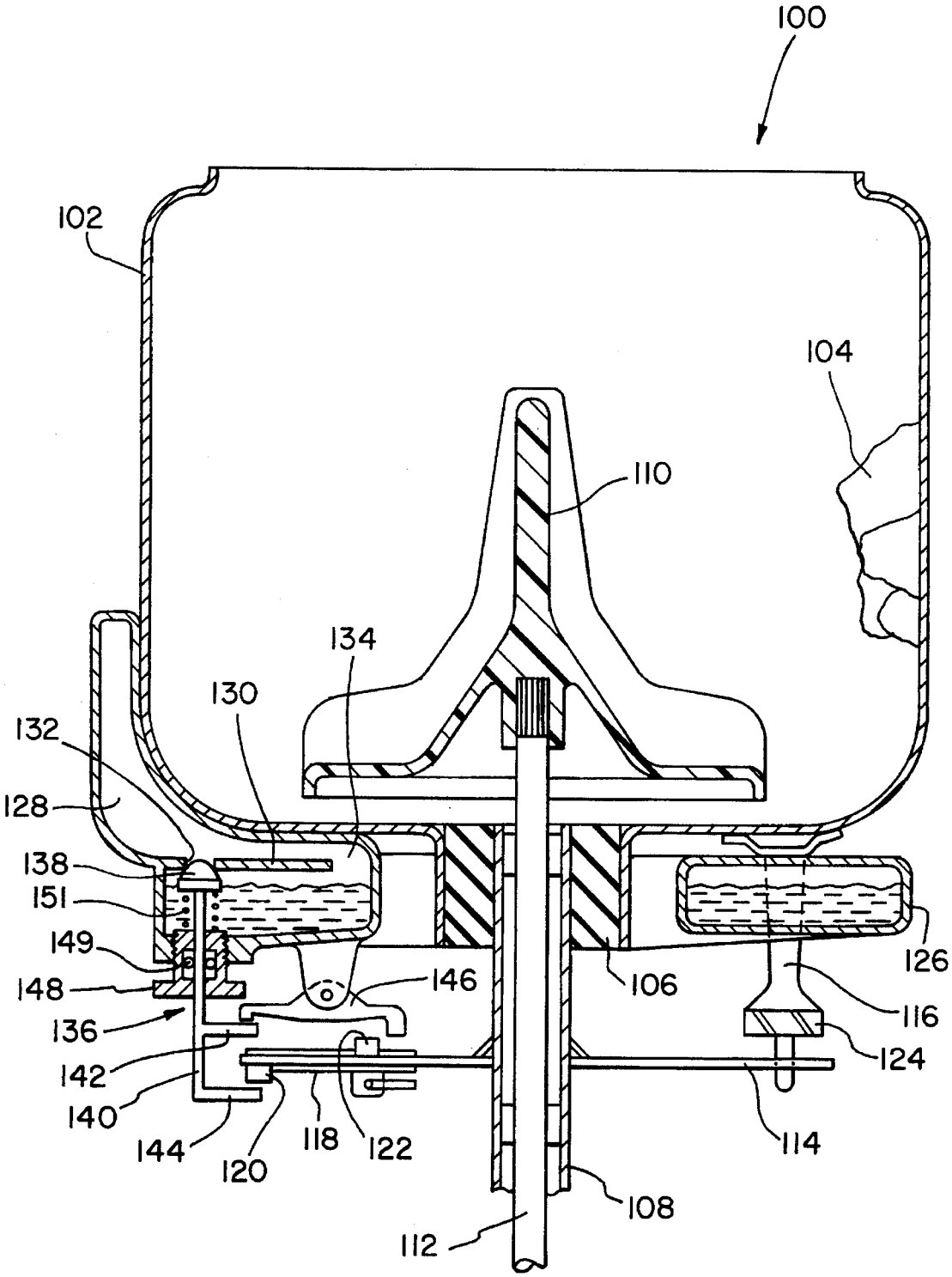
FIG. 5 is fragmentary, vertical sectional view of another embodiment of the balancing apparatus of the present invention installed in a vertical axis laundry appliance.

Referring now to FIG. 5, there is shown a fragmentary, vertical cross-sectional view of selected portions of another laundry appliance in which is installed a second embodiment of a balancing apparatus of the present invention which functions in a conceptually similar fashion to the embodiment described above. The shown laundry appliance, which is a vertical axis washing machine well known in the art, is generally designated 100 and includes a perforated, cylindrical clothes basket 102 in which an unbalanced batch of laundry is shown at 104. Clothes basket 102 is mounted via a resilient bushing 106 to a drive shaft 108 rotatably powered by a not shown motor. Agitator 110 is moved or oscillated within clothes basket 102 during the wash cycle by a motor powered drive shaft 112 axially extending through a bushing lined bore through drive shaft 108.

Fixedly secured to drive shaft 108 for rotation therewith is disc shaped drive plate 114. While only one is shown, three radially shiftable valve selector slides 118 spaced at 120° angular intervals are slidably mounted to drive plate 114. Each slide 118 includes a below critical speed lug 120 and an above Critical speed lug 122. The assembly used to shift slides 118 from the below basket critical speed arrangement shown to the radially inward, above basket critical speed arrangement is similarly configured to the embodiment of FIG. 1 and not shown for purposes of clarity of illustration. Spaced at 120° intervals are three drive lugs 116 provided with basket deflection limit pads 124. Drive lugs 116 are secured to the underside of clothes basket 102 and extend through holes in drive plate 114 for a positive drive engagement. A suitable ring switch actuator and associated switch and control means which the distal end of drive lugs 116 triggers during basket tilting is similar to the FIG. 1 configuration and is not shown.

Secured to the underside of clothes basket 102 is a self contained fluid tank 126 filled with fluid such as water which is not emptied during use so as to be reusable with subsequent washing loads. Fluid tank 126 is annular shape and its interior compartment is unsegmented along its entire 360° circumference such that water at any point of tank 126 can move to the appropriate balance tank 128. Upwardly extending from tank 126 is shown a sector balance tank or liquid receiving pocket 128. Three similarly constructed balance tanks 128 spaced at 120° intervals are preferably arranged on the outer periphery of clothes basket 102 and selectively filled with liquid to counterbalance unbalanced load 104. A top or barrier wall 130 of fluid supply tank 126 separating balance tank 128 from fluid supply tank 126 includes an inlet passage 132, and a vent and drain passage 134 near the inner radial portion of tank 126.

Inlet passage 132 is opened and closed to regulate the flow of fluid from fluid supply tank 126 into balance tank 128 by a push/pull valve generally designated 136. One valve 136 is preferably provided for each balance tank 128. Valve 136 includes a resilient valve seat 138 mounted on the distal end of valve shaft or rod 140. Actuating arms 142, 144 radially extend from rod 140. Activating arm 144 engages slide lug 120. Actuating arm 142 engages slide lug 122 via lever 146, which is pivotally mounted to fluid supply tank 126 and serves to transform axial motion of arm 142 as described below. Rod 140 extends through a plug assembly 148 inserted into fluid tank 126 that houses O-ring seal 149 to prevent fluid within tank 126 from leaking. Spring 151 biases valve seat 138 into sealing engagement with inlet passage 132.

The construction of this embodiment will be further understood in view of the following general explanation of its operation. It will be appreciated by those of ordinary skill in the art that the overall operation is similar to the operation of the embodiment of FIG. 1, and therefore the explanation of its operation will be more limited. During the spin cycle and when clothes basket 102 is rotating above a one gravity speed but below a critical speed, when the unbalanced load 104 is positioned as shown, clothes basket 102 will tilt relative to drive shaft 108 toward the right in FIG. 5. When tilted sufficiently, valve actuating arm 144 will abut slide lug 120. Upon further tilting of clothes basket 102, barrier wall 130 moves away from valve 136 to unseat valve seat 138 and open inlet passage 132. Water which fills the radially outward portions of fluid supply tank 126 due to the centrifugal force produced by rotation passes through inlet passage 132 to fill the appropriate sector balance tank 128 to counterbalance load 104. It will be appreciated that for the shown position of load 104 diametrically opposite balance tank 128, the valves 136 associated with the not shown tanks 128 will not be opened when barrier wall 130 moves axially toward drive plate 114 during basket tilting as their respective actuating arms 142 will not engage lugs 122 as the radially inward ends of their respective levers 146 are not aligned with lugs 122.

During rotation above the critical speed, valve selector slides 118 will be moved to a not shown, radially inward position whereby lugs 122 will be aligned for engagement with the radially inward ends of levers 146. When clothes basket 102 tilts to the left in FIG. 5, the inward leg of lever 146 contacts lug 122 and causes the outward leg of lever 146 to pivot further downward and force actuating arm 142 downward. The increased or magnified downward motion of arm 142 relative to fluid supply tank 126 unseats valve seat 138 and allows water in supply tank 126 to flow through passage 132 into balance tank 128 for counterbalancing purposes. When rotation is sufficiently slowed or stopped, water in balance tanks 128 automatically empty as water therein flows back by gravity to fluid supply tank 126 through drain passages 134.

While this invention has been described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A balancing apparatus for a centrifugal extractor machine including a rotatable drum mounted on a shaft, wherein the drum is tiltable relative to the shaft whereby an axis of rotation of the drum is angled relative to an axial direction in which the shaft extends, said balancing apparatus comprising:

at least one valve actuator arranged around the shaft;

a plurality of balancing pockets disposed around the drum for receiving fluid to counterbalance an unbalanced load in the rotatable drum tending to tilt the drum during drum rotation;

a plurality of fluid passages for communicating fluid to said plurality of balancing pockets;

at least one fluid supplier providing fluid to said plurality of fluid passages; and a plurality of valves controlling fluid flow through said plurality of fluid passages, said plurality of valves each structured and arranged to operatively engage said at least one valve actuator when said balancing pocket to which its respective valve passage communicates moves a distance toward said at least one valve actuator during drum tilting, wherein engagement of each valve with said at least one valve actuator opens said valve to allow fluid from said at least one fluid supplier to flow through said fluid passage associated with the open valve and into said balancing pocket associated with the open valve to counterbalance the unbalanced load.

2. The balancing apparatus of claim 1 wherein said at least one fluid supplier comprises a 360° self contained fluid tank mounted for rotation with the drum.

3. The balancing apparatus of claim 1 wherein said at least one fluid supplier comprises a 360° fluid supply ring, mounted for rotation with the drum, and a conduit connected to a fluid source for introducing fluid into said fluid supply ring.

4. In combination:

a laundry machine including a rotatable drum and a motor powered drive shaft driving the rotation of said rotatable drum, wherein said drum is tiltable relative to said drive shaft whereby an axis of rotation of said drum is angled relative to an axial direction in which said drive shaft extends; and a balancing apparatus for counterbalancing an unbalanced load in said rotatable drum, said balancing apparatus comprising:

at least one valve actuator corotatable with said drive shaft;

a plurality of balancing pockets disposed around the drum for receiving fluid to counterbalance the unbalanced load in said rotatable drum tending to tilt the drum during drum rotation;

a plurality of fluid passages for communicating fluid to said plurality of balancing pockets;

at least one fluid supplier providing fluid to said plurality of fluid passages; and a plurality of valves controlling fluid flow through said plurality of fluid passages, said plurality of valves each structured and arranged to operatively engage said at least one valve actuator when said balancing pocket to which its respective valve passage communicates moves a first distance toward said at least one valve actuator during drum tilting, wherein engagement of each valve with said at least one valve actuator opens said valve to allow fluid from said at least one fluid supplier to flow through said fluid passage and into said balancing pocket associated with the open valve to counterbalance the unbalanced load.

5. The combination of claim 4 wherein said laundry machine further comprises at least one resilient bushing between said rotatable drum and said drive shaft allowing tilting motion therebetween.

6. The combination of claim 4 wherein said plurality of valves are each pivotally mounted to said rotatable drum.

7. The combination of claim 4 wherein said at least one valve actuator comprises at least one base member and a plurality of valve selector slides mounted to said at least one base member in registry with said plurality of valves, wherein each slide is shiftable between first and second positions, wherein each said valve comprises a first actuating member and a second actuating member, wherein each corresponding valve and slide is complementarily configured such that said first actuating member is engagable with said slide when said slide is disposed in said first position and said balancing pocket associated with said valve moves said first distance toward said at least one base member during drum tilting, wherein said first actuating member is not engagable with said slide when said slide is disposed in said second position and said balancing pocket associated with said valve moves said first distance toward said at least one base member during drum tilting, wherein said second actuating member is engagable with said slide when said slide is disposed in said second position and said balancing pocket associated with said valve moves a second distance away from said at least one base member during drum tilting, and wherein said second actuating member is not engagable with said slide when said slide is disposed in said first position and said balancing pocket associated with said valve moves said second distance away from said at least one base member during drum tilting.

8. The combination of claim 7 wherein said first actuating members are disposed on valve shafts, and wherein said plurality of valves further comprise levers for transforming motion of said first actuating members during engagement with said slides.

9. The combination of claim 7 wherein said at least one base member comprises a rigid drive plate.

10. The combination of claim 7 wherein said plurality of valve selector slides are radially shiftable between said first and second positions.

11. The combination of claim 10 further comprising means for shifting said plurality of valve selector slides from said first positions to said second positions, said shifting means comprising a collar axially slidable on said drive shaft and connected by linkages to said slides.

12. The combination of claim 4 wherein said laundry machine further comprises a plurality of drive lugs fixed to said drum and axially extending through said at least one valve actuator.

13. The combination of claim 12 further comprising switch means actuated by said drive lugs for use in controlling rotation of said rotatable drum.

14. The combination of claim 12 wherein said laundry machine further comprises pads mounted on said drive lugs to contact said at least one valve actuator and limit drum tilting.

15. The combination of claim 4 wherein said at least one fluid supplier comprises a 360° self contained fluid tank mounted for rotation with said drum.

16. The combination of claim 4 wherein said at least one fluid supplier comprises a 360° fluid supply ring, mounted for rotation with the drum, and a conduit connected to a fluid source for introducing fluid into said fluid supply ring.

17. The combination of claim 4 wherein said plurality of balancing pockets comprises a plurality of baffle tanks positioned within said rotatable drum.

18. The combination of claim 4 wherein said plurality of balancing pockets comprises three balancing pockets spaced about 120° apart.

19. A laundry apparatus comprising:

a rotatable drum;

a motor powered drive shaft driving the rotation of said rotatable drum;

resilient means for mounting said rotatable drum to said drive shaft to allow limited tilting of said rotatable drum relative to an axis of rotation of said drive shaft;

valve actuator means corotatably mounted to said drive shaft;

a plurality of balancing pockets disposed around the drum for receiving fluid to counterbalance an unbalanced load in the rotatable drum tending to tilt the drum during drum rotation;

a plurality of fluid passages for communicating fluid to said plurality of balancing pockets;

means for supplying fluid to said fluid passages; and valve means for operatively engaging said valve actuator means during drum tilting to selectively open said plurality of fluid passages to permit fluid flow from said fluid supplying means into said plurality of balancing pockets to counterbalance the unbalanced load in said rotatable drum.

20. The combination of claim 19 wherein said valve means comprises first means for opening said fluid passages when said rotatable drum rotates below a predetermined speed and second means for opening said fluid passages when said rotatable drum rotates above said predetermined speed.

21. The combination of claim 19 wherein said valve actuator means comprises a plurality of slider means shiftable between first and second positions, said slider means operatively engagable with said first means of said valve means only when disposed in said first position, said slider means operatively engagable with said second means of said valve means only when disposed in said second position.

* * * * *